US005358250A

United States Patent [19]

Spencer

[11] Patent Number: 5,358,250

[45] Date of Patent: Oct. 25, 1994

[54] GOLF CLUB SWING TRAINING AID

[76] Inventor: Harold L. Spencer, 10327 Hwy. 150, Greenville, Ind. 47124

[21] Appl. No.: 179,325

[22] Filed: Jan. 10, 1994

[51] Int. Cl.[5] ..... A63B 69/36

[52] U.S. Cl. ..... 273/187.2; 273/188 R

[58] Field of Search ..... 273/188 R, 188 A, 189 R, 273/190 R, 187.2

[56] References Cited

U.S. PATENT DOCUMENTS

| | | | |
|---|---|---|---|
| 1,561,960 | 11/1925 | Ungar | 273/188 R |
| 1,703,375 | 2/1929 | Volk | 273/188 R |
| 3,870,317 | 3/1975 | Wilson | 273/188 R |
| 3,937,473 | 2/1976 | Blasi | 273/188 R X |
| 4,593,909 | 6/1986 | Anselmo et al. | 273/188 R |
| 5,013,044 | 5/1991 | Hesselbart | 273/191 R X |
| 5,048,836 | 9/1991 | Bellagamba | 273/188 R X |
| 5,188,366 | 2/1993 | Dorotinsky et al. | 273/188 R |
| 5,209,482 | 5/1993 | Hopfer | 273/188 R X |

*Primary Examiner*—George J. Marlo
*Attorney, Agent, or Firm*—Maurice L. Miller, Jr.

[57] ABSTRACT

A golf club swing training aid is disclosed which includes a waist belt, a ground mountable frame adapted to extend vertically to about a waist-high level relative to a golfer using the aid, and an elastomeric cord connected on one end to a medial position on the back of the belt when the belt is worn by the golfer in an operative waist encircling position. The frame contains a pair of spaced apart, parallel extending legs adapted for mounting in the ground immediately laterally adjacent the golfer when standing in a position to properly address a golf ball with a golf club such that the legs of the frame are aligned with the legs of the golfer parallel to the intended line of flight of the golf ball. The other end of the cord is removably attachable to an eye bolt affixed to an upper end of one of the frame legs. The frame may include an inverted U-shaped upper section made of hollow aluminum alloy tubing and an H-shaped lower section made of rigid steel rods. Upper end portions of two parallel members of the lower section are spaced apart and are of diameters sufficient to insert into lower end portions of the upper section in relatively close fitting, slidably relationship. The training aid helps to eliminate improper leaning or swaying of the golfer which can adversely affect the accuracy and drive power of his golf club swing motion.

20 Claims, 2 Drawing Sheets

GOLF CLUB SWING TRAINING AID

BACKGROUND OF THE INVENTION

This invention relates generally to a device for teaching the proper stance of a golfer throughout the swinging movement of a golf club. More specifically, the invention relates to a golf club swing training device which includes a waist belt attachable around the waist of golfer and attachable by means of a stretchable, resilient cord to a stable ground stake positioned to one side of the golfer.

Generally speaking, golf club swing training aids for perfecting the stance and club swing of a golfer have been known and used in the prior art. See, for example, U.S. Pat. No. 5,188,366 issued to D. R. Dortinsky et al. on Feb. 23, 1993; U.S. Pat. No. 5,013,044 issued to F. C. Hesselbart on May 7, 1991; U.S. Pat. No. 3,937,473 issued to A. R. Blasi on Feb. 10, 1976; U.S. Pat. No. 3,870,317 issued to B. W. Wilson on Mar. 11, 1975. U.S. Pat. No. 1,703,375 issued to A. C. Volk on Feb. 26, 1929; and U.S. Pat. No. 1,561,960 issued to H. A. Ungar on Nov. 17, 1925. Of these patents, all but the Hesselbart patent involve a waist encircling band or belt attached either directly or by means of a cord to a stationary element such as a wall, ground stake or upstanding rod. However the waist encircling band shown in the Blasi patent is an oversize ring which encircles but is spaced from a golfer's body during a golf swing. The ring is not to be touched by the golfers body during his swing, in default of which contact switches located in the ring actuate an alarm to indicate that the golfer was not in proper balance during his golf swing. The remaining patents to Dortinsky et al., Wilson, Volk and Ungar show the use of relatively close fitting waist belts. Of these four patents, the waist belts of Volk and Ungar are attached at a stationary position directly behind the golfer.

The Wilson patent discloses a relatively tight fitting waist belt connected by means of an elastic cord to a waist high upper end portion of a vertically extending ground stake. The stake is laterally spaced from the golfer on the same side of his body as his back swing is taken, preparatory to his taking a forward swing at a golf ball. The cord is connected from the stake to the back of the belt over the hip of the golfer which is located on his opposite side from the side on which his back swing is taken. The weight of the golfer is placed so as to effect a slight stretching of the cord so as to hold him in proper position in both the back swing and forward swing portions of his club swing.

One problem encountered using the Wilson device is in obtaining the precise positioning of the ground stake laterally spaced apart from the golfer so as to obtain the precisely desired amount of tension in the elastic cord during all positions of the golf swing. Another problem is in assuring that the ground stake is not in the way of the golfer's swing since it is located on his back swing side which is also the side of the first half of his forward swing. Yet another problem is the tendency of the cord to apply a bending moment to an upper end of the stake which tends to pull the stake over toward the golfer during the golf swing. None of the reference patents teach means for inhibiting the lateral sway of a golfer to both sides of the resting position of a golf ball which can otherwise occur during his club swing. Such swaying often takes the golfer out of proper alignment and can materially diminish the accuracy and power of his swing.

By means of the present invention, these and other difficulties encountered when using prior art golf club swing training devices are substantially overcome.

SUMMARY OF THE INVENTION

It is an object of my invention to provide a novel golf club swing training device.

It is another object of my invention to provide such a device including a highly stable ground mountable frame for alignment of a golfer's body immediately adjacent thereto to aid in his maintenance of a proper stance throughout a golf club swing.

Briefly, in accordance with the present invention, there is provided a golf club swing training device. The device includes ground mountable frame means adapted for disposition immediately beside a golfer for inhibiting a swaying movement of the golfer in a direction of a follow through portion of the golfer's forward swing of a golf club. The device also includes stretchable, resilient means, one end of which is attachable to a back central portion of the golfer's waist. The other end is removably attachable to the frame means for inhibiting a swaying movement of the golfer in a direction opposite the direction of the follow through portion of the golfer's forward swing of a golf club.

These and other objects, features and advantages of the present invention will become apparent to those skilled in the art from the following detailed description and attached drawings on which, by way of example, only a preferred embodiment of the invention is illustrated.

DESCRIPTION OF THE PREFERRED EMBODIMENT

Figure 1:
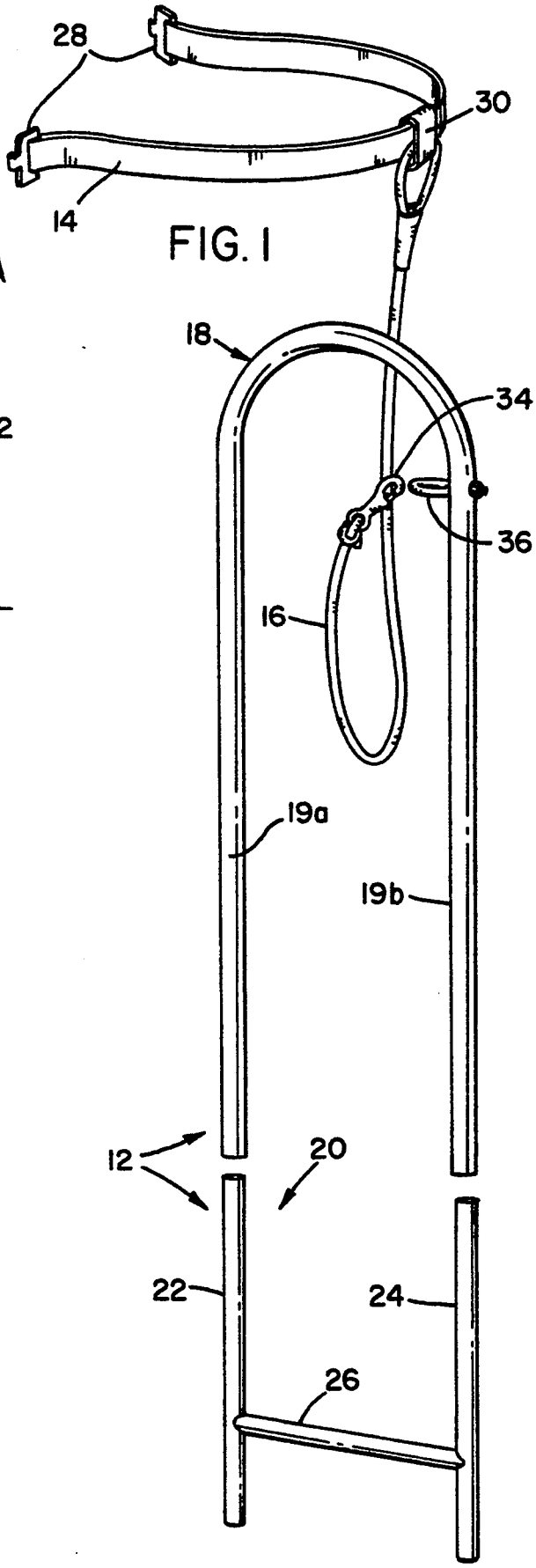
FIG. 1 shows a perspective view of a golf club swing training device, thus illustrating a preferred embodiment of my invention.

Referring now to the drawing figures and, in particular to FIG. 1, there is shown, in a preferred embodiment of my invention, a golf club swing training device, generally designated 10, which includes a ground mountable, inverted U-shaped frame 12, a waist belt 14, and a stretchable, resilient or elastomeric cord 16.

The frame 12 preferably includes an inverted U-shaped upper section 18, which may be formed from a single piece of hollow aluminum alloy tubing so as to have two parallel, spaced apart, vertically extending legs **19*a* and 19*b*, and an H-shaped lower section 20, which may be made of three steel rods 22, 24 and 26 welded or otherwise suitably connected together as shown. The rods 22 and 24 should be spaced apart and have diameters sufficient to allow upper end portions thereof to be removably inserted into lower end portions of the legs 19***a* and *b* in relatively close fitting, slidable relationship. They should be sufficient to maintain the frame 12 in a relatively rigid stance when in use, yet be readily inserted on lower end portions thereof into ground laterally adjacent the position of the user of the device 10, up to the level of the cross-member 26. In staking the frame 12 in the ground, the user may force the lower end portions of the rods 22 and 24 into the ground by pressing down with one foot upon the cross-member 26 while holding an upper end portion of the section 18 in his hands.

The belt 14 is flexible and includes a suitable buckle 28. It can be made adjustable if desired to fit various waist sizes. The cord 16 is connected on one end to a belt loop 30 located at the mid-point of the belt 14 so as to be connected at the mid point of the back of a golfer 32. The connection of the cord 16 to the belt 14 may, but need not necessarily be, a removable type of connection. In the event the belt 14 is made to be adjustable, then the belt loop 30 should also have corresponding adjustment capability to assure that the connection of the former to the latter is always substantially centered on the lower back of the user when the belt 14 is worn. The other end of the cord 16 terminates into a conventional snap hook 34 which is removably attachable to an eye bolt 36 affixed to an upper end portion of the frame leg 19*b*.

Figure 2:
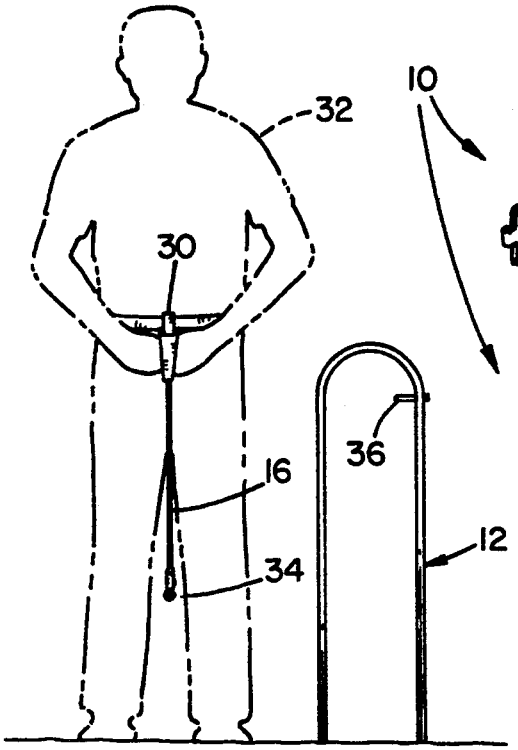
FIG. 2 shows a rear elevation view of a golfer standing beside a ground mounted frame portion of the device of FIG. 1 illustrating with hands behind his back the proper positioning of waist belt and elastic cord portions of the device of FIG. 1.
Figure 3:
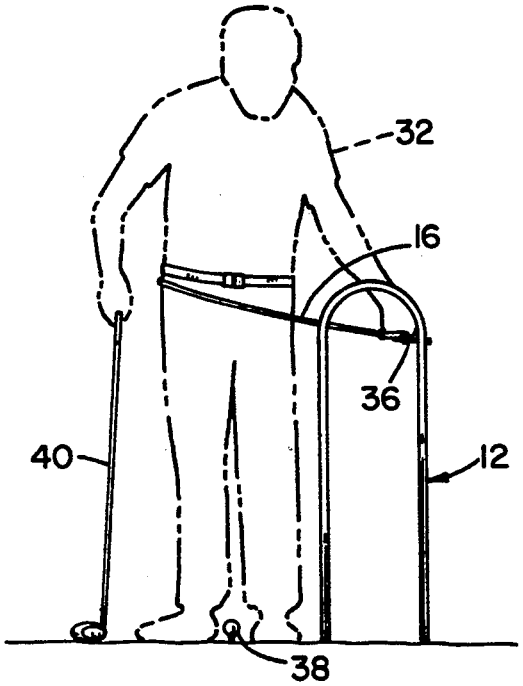
FIG. 3 shows a front elevation view of the golfer and device of FIG. 2 illustrating the proper attachment to the frame portion and arrangement of the elastic cord portion.

In typical operation, the frame 12 is assembled and lower end portions of the legs 22 and 24 are inserted into the ground by pushing with one foot downwardly against the cross member 26 while holding an upper part of the upper section 18 with the hands to plumb and stabilize the assembly. The frame 12 is positioned immediately beside the hip of the golfer 32 which is opposite his back swing side as shown, for example, in FIG. 5. The legs 19*a* and 19*b* of the frame 12 are in line with the legs of the golfer 32 when properly addressing a golf ball preparatory to beginning the back swing as shown, for example, in FIG. 4. The cord 16 is then directed by the golfer 32 from its point of attachment 30 on the waist belt 14, located at the mid-point of his back, around his waist on his back swing side, thence across his abdomen and behind frame leg 19*a* to connect by means of the snap hook 34 to the eye bolt 36 on the upper end of frame leg 19*b* as shown in FIG. 3.

Figure 4:
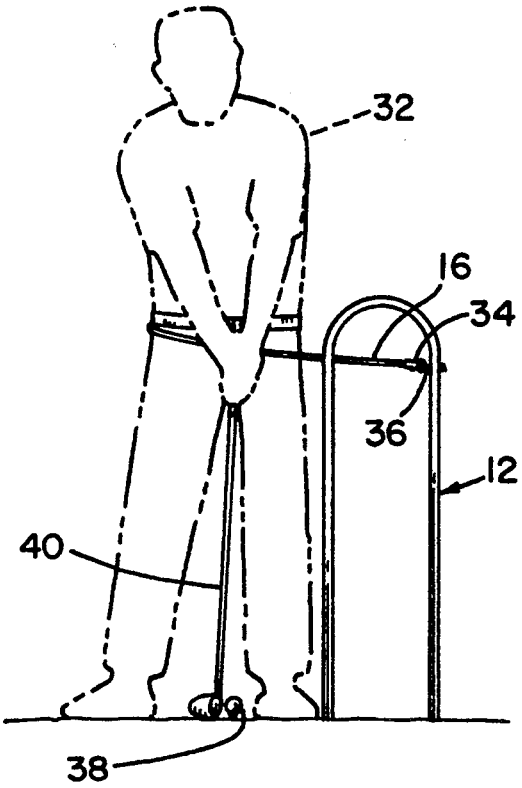
FIGS. 4–7 show front elevation views of the golfer and device of FIG. 3 in its operative condition illustrating, respectively, the golfer addressing a golf ball, the golfer with arms poised at the peak of his back swing, the golfer with arms at the mid-point of his forward swing, and the golfer at the completion of his forward swing.
Figure 5:
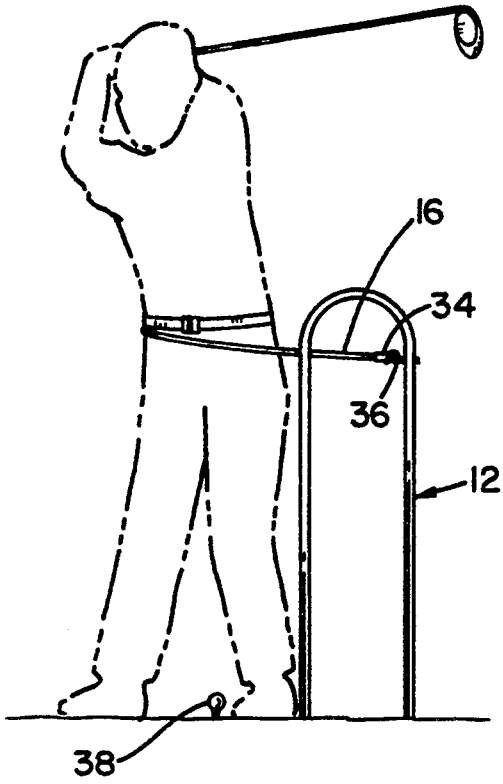
Figure 6:
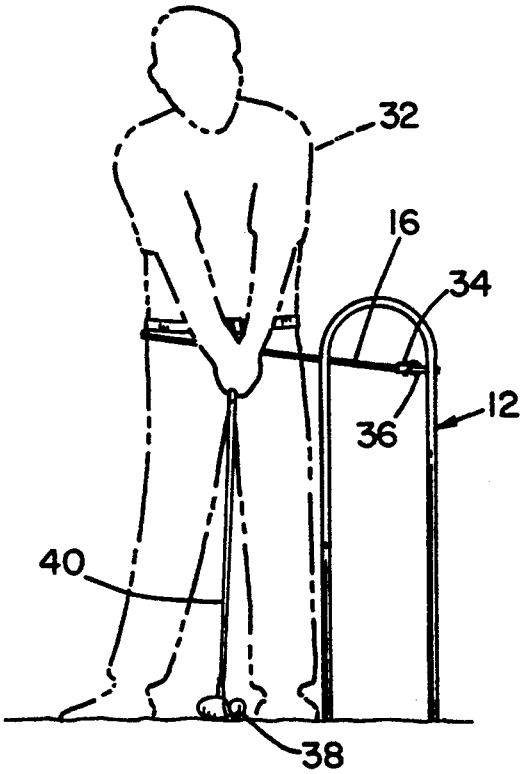
Figure 7:
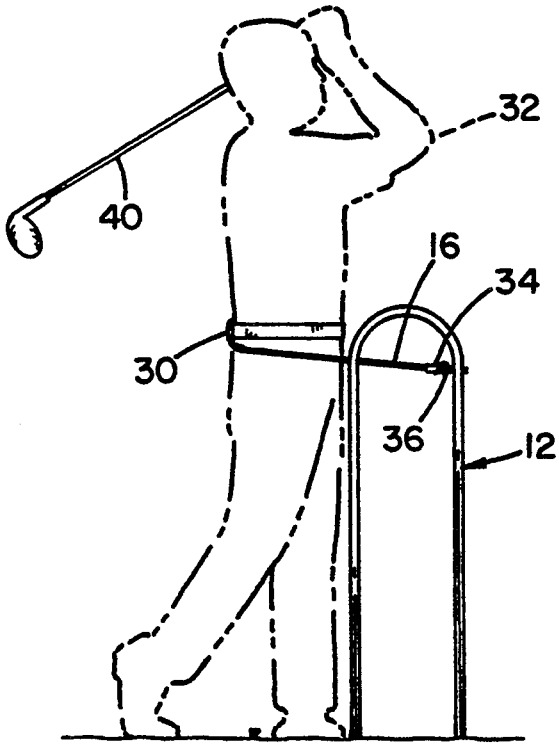

With the device 10 thus connected to the golfer 32, he positions himself immediately laterally adjacent frame leg 19*a* and addresses a golf ball 38 with a golf club 40 such that the cord 16 is in a slightly stretched or tensioned condition as in FIG. 4. The club is then raised in the back swing while the golfer turns his body into the back swing, thus raising the tension in the belt 16. Thus, as shown in FIG. 5, the golfer's lower body portion is held in a substantially plumb position over the golf ball and is not drawn appreciably to the left of his stance as shown in FIG. 4 when properly executing the back swing. The forward swing now occurs, the mid-point of which is shown in FIG. 6 wherein the cord 16 carries essentially the same tension as it carried while the golfer was addressing the ball (FIG. 4), indicative that his body has not tilted toward one side of the ball 38 so as to be out of alignment with the ball 38 when it is struck with the club 40. Finally, as shown in FIG. 7 and after striking the ball 38 with his club 40, the golfer 32 turns toward the direction of the ball 38 in flight during the follow through portion of his forward swing, while still maintaining his relatively close spacing from the leg 19*a* of the frame 12. Because he has not leaned substantially away from the frame 12 during his back swing and because he has not leaned into the frame 12 from the mid-point of his forward swing through completion of the follow-through portion thereof, the golfer has maintained a proper stance throughout his swing which translates into improved accuracy and driving power. The device 10 thus tends to inhibit the lateral sway of a golfer to either side of the resting position of the ball during the entire golf swing from back swing to completion of the follow through portion of his forward swing. See FIGS. 4–7 in that order.

This device, when properly attached to the golfer, will produce a forward rotation of the pelvis during the forward swing to generate power for striking the golf ball. The frame will encourage maintenance of balance and prohibit excessive lateral sway during the golf swing.

The use of the frame 12 with two legs 19*a* and 19*b* which are in line with both of the golfer's legs while he is in the ball addressing position of FIG. 4, adds considerably to rhe stability of the device 10 and prevents the golfer from pulling or jerking the upper end of the frame 12 over toward him during the swing. It will be appreciated that the frame 12 could, if preferred, be bent to form using a single elongated member such as the upper section 18, in which event the member could be either hollow or solid. The lower end portions of the members 22 and 24 below the level of the cross-member 26 can be tapered for ease of insertion into the ground if desired, although I have not found this to be necessary in my testing of the assembly.

Although the present invention has been shown and described with respect to specific details of a certain preferred embodiment thereof, it is not intended that such details limit the scope of my invention other than as specifically set forth in the following claims.

I claim:

1. A golf club swing training device comprising ground mountable frame means adapted for disposition immediately beside a golfer for inhibiting a swaying movement of said golfer in a direction of a follow through portion of said golfer's forward swing of a golf club, stretchable, resilient means, one end of which is attachable to a back central portion of said golfer's waist and being removably attachable on the other end thereof to said frame means for inhibiting a swaying movement of said golfer in a direction opposite the direction of said follow through portion.

2. The device of claim 1 wherein said frame means extends essentially waist high relative to said golfer when ground mounted immediately beside said golfer.

3. The device of claim 1 wherein said frame means includes two parallel, spaced apart legs.

4. The device of claim 1 wherein said frame means comprises an inverted U-shaped frame as viewed in an operative, ground mounted position.

5. The device of claim 4 wherein said frame comprises an inverted U-shaped upper section forming two parallel extending, spaced apart legs, said legs being hollow and open ended, and an H-shaped lower section including two rigid, parallel, spaced apart members joined on central portions thereof by a rigid cross-member, upper end portions of said two members being removably insertable into corresponding lower end portions of said legs.

6. The device of claim 1 wherein said stretchable, resilient means comprises an elastomeric cord.

7. The device of claim 1 further comprising a snap hook affixed on said other end of said stretchable, resilient means.

8. The device of claim 1 further comprising an eye bolt connected to an upper end portion of said frame means for connection of said other end of said stretchable, resilient means thereto.

9. A golf club swing training device comprising a belt adapted to encircle the waist of a golfer, a ground mountable frame extending vertically about waist high relative to said golfer, said frame containing two parallel, spaced apart legs, and stretchable, resilient means attached on one end to said belt and being removably attachable on the other end thereof to an upper end portion of one of said legs.

10. The device of claim 9 wherein said frame comprises an inverted U-shaped assembly.

11. The device of claim 9 wherein said means attaches on said one end to a portion of said belt positioned medially on the back of the waist of said golfer when said belt is disposed in an operative waist encircling position.

12. The device of claim 9 further comprising a snap hook affixed on the other end of said means for removably attaching said other end of said means to said frame.

13. The device of claim 9 further comprising an eye bolt connected to an upper end portion of one of said frame legs.

14. The device of claim 13 wherein an eye of said eye bolt is positioned between and in line with said frame legs.

15. The device of claim 9 wherein said means comprises an elastomeric cord.

16. The device of claim 14 wherein said cord, when in an operative condition with said belt attached around the waist of said golfer, extends from a central position on the back of said golfer's waist around his hip which is located on his back swing side, thence across his abdomen behind a first one of said legs which is located immediately adjacent his hip on his forward swing follow-through side to make attachment to an upper end portion of the second of said legs, said two legs being in line with the legs of said golfer when he is in a position to properly address a golf ball with a golf club.

17. The device of claim 9 wherein said frame comprises an upper section forming said two legs wherein said two legs are hollow and open ended, and a lower H-shaped section including two rigid, parallel, spaced apart members joined on central portions thereof by a rigid cross-member, upper end portions of said two members being removably insertable into corresponding lower end portions of said two upper section legs.

18. The device of claim 17 wherein said upper section comprises a single piece of hollow pipe.

19. The device of claim 18 wherein said pipe is constructed of aluminum alloy tubing.

20. The device of claim 18 wherein lower end portions of said two members are adapted to be forced into ground immediately laterally adjacent a golf club swinging position of said golfer up to the level of said cross-member by pressing on said cross-member with a person's foot such that said frame stands rigidly upright.

* * * * *